US008555768B1

(12) United States Patent
Barker et al.

(10) Patent No.: US 8,555,768 B1
(45) Date of Patent: Oct. 15, 2013

(54) SHOCK WAVE BARRIER USING MULTIDIMENSIONAL PERIODIC STRUCTURES

(75) Inventors: Delmar L. Barker, Tucson, AZ (US); Kenneth L. Moore, Sahuarita, AZ (US); William R. Owens, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 288 days.

(21) Appl. No.: 13/093,602

(22) Filed: Apr. 25, 2011

Related U.S. Application Data

(63) Continuation-in-part of application No. 12/473,275, filed on May 28, 2009, now Pat. No. 8,082,844.

(51) Int. Cl.
*F41H 5/24* (2006.01)

(52) U.S. Cl.
USPC ..... 89/36.01; 89/920

(58) Field of Classification Search
USPC ..... 89/36.01, 36.04, 36.11, 36.02; 109/49.5; 102/303; 52/506.1, 1
See application file for complete search history.

(56) References Cited

U.S. PATENT DOCUMENTS

| | | | | | |
|---|---|---|---|---|---|
| 2,393,350 | A | * | 1/1946 | Wiedman | 109/49.5 |
| 3,394,843 | A | | 7/1968 | Grady, Jr. et al. | |
| 4,055,247 | A | | 10/1977 | Benedick et al. | |
| 4,145,972 | A | | 3/1979 | Menz et al. | |
| 4,248,342 | A | | 2/1981 | King et al. | |
| 4,325,304 | A | | 4/1982 | Ormiston | |
| 4,325,309 | A | * | 4/1982 | King et al. | 109/49.5 |
| 4,347,796 | A | | 9/1982 | King et al. | |
| 4,389,947 | A | | 6/1983 | King et al. | |
| 4,475,461 | A | | 10/1984 | Durrell | |
| 4,899,663 | A | | 2/1990 | Thorn | |
| 4,976,199 | A | | 12/1990 | Beukes et al. | |
| 5,076,168 | A | * | 12/1991 | Yoshida et al. | 102/303 |
| 5,214,235 | A | * | 5/1993 | Froeschner | 89/36.13 |
| 5,375,527 | A | | 12/1994 | Nakajima | |
| 5,388,521 | A | | 2/1995 | Coursen | |
| 5,394,786 | A | * | 3/1995 | Gettle et al. | 86/50 |
| 6,298,766 | B1 | * | 10/2001 | Mor | 89/36.04 |
| 7,213,494 | B2 | * | 5/2007 | James | 86/50 |
| 7,292,740 | B1 | | 11/2007 | Barker et al. | |
| 7,418,373 | B2 | | 8/2008 | Heck, Sr. | |
| 7,421,936 | B2 | * | 9/2008 | Barger et al. | 89/36.02 |
| 7,437,987 | B1 | * | 10/2008 | Ohnstad et al. | 89/36.04 |
| 7,575,797 | B2 | * | 8/2009 | Karr et al. | 428/137 |
| 7,878,103 | B2 | * | 2/2011 | Imholt et al. | 89/36.08 |
| 7,886,667 | B1 | | 2/2011 | Baker et al. | |

(Continued)

*Primary Examiner* — Bret Hayes
*Assistant Examiner* — Reginald Tillman, Jr.
(74) *Attorney, Agent, or Firm* — Eric A. Gifford

(57) ABSTRACT

A shock wave barrier comprises a periodic structure having the proper symmetry and local contrast modulation of the acoustic index to divert an incident shock wave by using constructive/destructive interference phenomena that produce a "band gap" in the transmission spectrum of the periodic structure. In general, shock wave energy within the band gap is reflected from the structure. Defect cavities may be formed in the periodic structure to create transmission resonances or "windows" in the band gap. A portion of the incident energy passes through the window and is concentrated in the defect cavities where it is dissipated by other means. The band gap can be quite wide, at least 50% of the center wavelength, and thus can provide an effective barrier from a wide variety of threats with varying blast pressure and range. The structure may be periodic in two or three dimensions providing a band gap barrier in two or three dimensions, respectively.

20 Claims, 13 Drawing Sheets

(56) References Cited

U.S. PATENT DOCUMENTS

| | | | | |
|---|---|---|---|---|
| 2003/0183109 | A1 | 10/2003 | Rudhard et al. | |
| 2004/0154463 | A1* | 8/2004 | Edberg et al. | 89/36.04 |
| 2005/0016407 | A1 | 1/2005 | Bernard | |
| 2007/0144337 | A1* | 6/2007 | Zhang et al. | 89/36.01 |
| 2007/0245887 | A1* | 10/2007 | James | 89/36.01 |
| 2008/0257137 | A1* | 10/2008 | James | 86/50 |
| 2008/0264245 | A1* | 10/2008 | Barnes et al. | 89/36.02 |
| 2008/0282925 | A1 | 11/2008 | Lownds et al. | |
| 2010/0000399 | A1* | 1/2010 | Barnes et al. | 89/36.02 |

* cited by examiner

SHOCK WAVE BARRIER USING MULTIDIMENSIONAL PERIODIC STRUCTURES

CROSS-REFERENCE TO RELATED APPLICATIONS

This application claims benefit of priority under 35 U.S.C. 120 as a continuation-in-part of U.S. application Ser. No. 12/473,275 entitled "Acoustic Crystal Explosives" and filed on May 28, 2009 now U.S. Pat. No. 8,082,844, the entire contents of which are incorporated by reference.

BACKGROUND OF THE INVENTION

1. Field of the Invention

This invention relates to protection of assets in protected areas from shock waves such as produced by explosive detonation.

2. Description of the Related Art

Explosive detonation may produce a shock wave that propagates outwardly from the point of detonation through a media such as air, liquid or a solid. The shock wave is a pressure wave that travels at supersonic speed in the media. The shock wave is characterized by an abrupt, nearly discontinuous change in the characteristics of the medium. Across the shock there is an extremely rapid rise in pressure, temperature and density of the flow. The shock wave carries a large amount of energy in a small volume that can be very destructive. However, the energy of the shock wave dissipates relatively quickly with distance. Furthermore, the accompanying expansion wave approaches and eventually merges with the shock wave, partially cancelling it out. In many explosives, the expansive wave expels metal fragments that provide additional destructive capability.

To protect assets such as buildings or large equipment from the shock waves and fragments resulting from nearby explosive detonations, mass may be placed around the protected area between the asset and an explosive detonation. The mass absorbs the energy in the shock wave through translation of the mass and/or internal friction due to deformation of the mass. Large amounts of mass are required to adequately protect the asset from potential threats. The "mass" may be earth/sand filled plywood walls, earth/sand filled tire walls or vertical reinforced concrete walls. Water filled bladders may be used to absorb the energy in the shock wave and convert it to a vertical spray of water. The mass also provides a barrier to the expelled fragments.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

A shock wave barrier comprises a periodic structure having the proper symmetry and local contrast modulation of the acoustic index to divert an incident shock wave by using constructive/destructive interference phenomena that produce a "band gap" in the transmission spectrum of the periodic structure.

In an embodiment, the shock wave barrier comprises first and second media arranged in a periodic structure positioned between a protected area and a potential threat. The first and second media have different acoustic indices of refraction that provide a local contrast modulation of the acoustic index. The symmetry of the periodic structure and local contrast modulation define a band gap in a transmission spectrum of the periodic structure. The first and second media are spaced in the periodic structure to position the band gap coincident with the dominant wavelength of a shock wave produced by the potential threat. The periodic structure is suitably configured such that the band gap spans the dominant wavelengths incident on the structure for a variety of potential threats. The dominant wavelength is a function of the blast pressure of the explosive detonation and the range to the explosive detonation. Generally speaking, the energy of the incident shock wave that lies within the band gap is substantially reflected by the periodic structure.

In an embodiment, the periodic structure is defined by the lattice symmetry of a crystal or quasi-crystal that form band gaps. A crystal lattice exhibits translational symmetry if the structure may be shifted at a certain period and remains identical. The quasi-crystal lattice exhibits rotational symmetry if the structure may be rotated through a certain angle (less than 360 degrees) and remains identical. Rotational symmetry may also provide the added benefit of providing no linear path through the structure thereby enhancing the structure's capability as a fragment barrier. Translation or rotational symmetry is a necessary but not sufficient condition to produce a band gap. Certain crystal lattices exhibit both translational and rotational symmetry.

In an embodiment, the local contrast modulation of the acoustic indices is equivalent to a velocity contrast in the shock wave incident upon the first few layers of the periodic structure where the wave constructively and destructively interferes. The wavelength at the center of the band gap is approximately equal to or at least on the order of the spacing 'd' in the periodic structure. The local contrast modulation largely determines the width of the band gap; the greater the contrast the greater the width. A minimum contrast modulation of approximately 2:1 is needed for a complete band gap. Contrast modulations of 10:1 or greater may be achieved (e.g. steel rods in air or void spaces in concrete) that produce a 50% band gap or greater for acoustic applications. The width of the band gap is typically referenced to its center wavelength.

In an embodiment, the periodic structure comprises a two-dimensional structure that provides local contrast modulation in a two-dimensions. One example is a two-dimensional array of linear elements in air positioned adjacent to or surrounding a protected area. This periodic structure would present a band gap to shock waves travelling along the ground toward the protected area or anywhere in the plane but not perpendicular to the plane of the shock wave. The linear elements could be retracted to provide ingress or egress to the protected area and then deployed to provide the shock wave barrier.

In an embodiment, the periodic structure comprises a three-dimensional structure that provides local contrast modulation in three-dimensions. One example is a concrete hemisphere or box with a periodic array of void three-dimensional objects positioned over the protected area. This structure would present band gaps to shock waves travelling along the ground toward the protected area or shock waves from airborne explosive detonations travelling down towards the protected area.

In an embodiment, one or more defect cavities are formed in the first few layers of the periodic structure in which the constructive/destructive interference occurs. The defect cavity (ies) creates a transmission resonance or "window" in the band gap that allows energy from the shock wave to be collected by the defect cavities. The defect cavity may be detuned to control the width of the window. The collected energy may be dissipated in the defect cavities by, for example, expelling a material such as water or sand that fills the cavity. The collected energy may be rerouted through the periodic structure around the protected area via a waveguide formed by a pattern of defect cavities.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a shock wave barrier. This is accomplished with a periodic structure having the proper symmetry and local contrast modulation of the acoustic index to divert an incident shock wave by using the constructive/destructive interference phenomena that produces a "band gap" in the transmission spectrum of the periodic structure. In general, shock wave energy at wavelengths within the band gap is reflected from the structure. Defect cavities may be formed in the periodic structure to create transmission resonances or "windows" in the band gap. A portion of the incident energy passes through the window and is concentrated in the defect cavities where it is dissipated by other means. The band gap can be quite wide, at least 50% of the center wavelength, and thus can provide an effective barrier from a wide variety of threats with varying blast pressure and range. The structure may be periodic in two or three dimensions providing a band gap barrier in two or three dimensions, respectively.

Figure 1A:
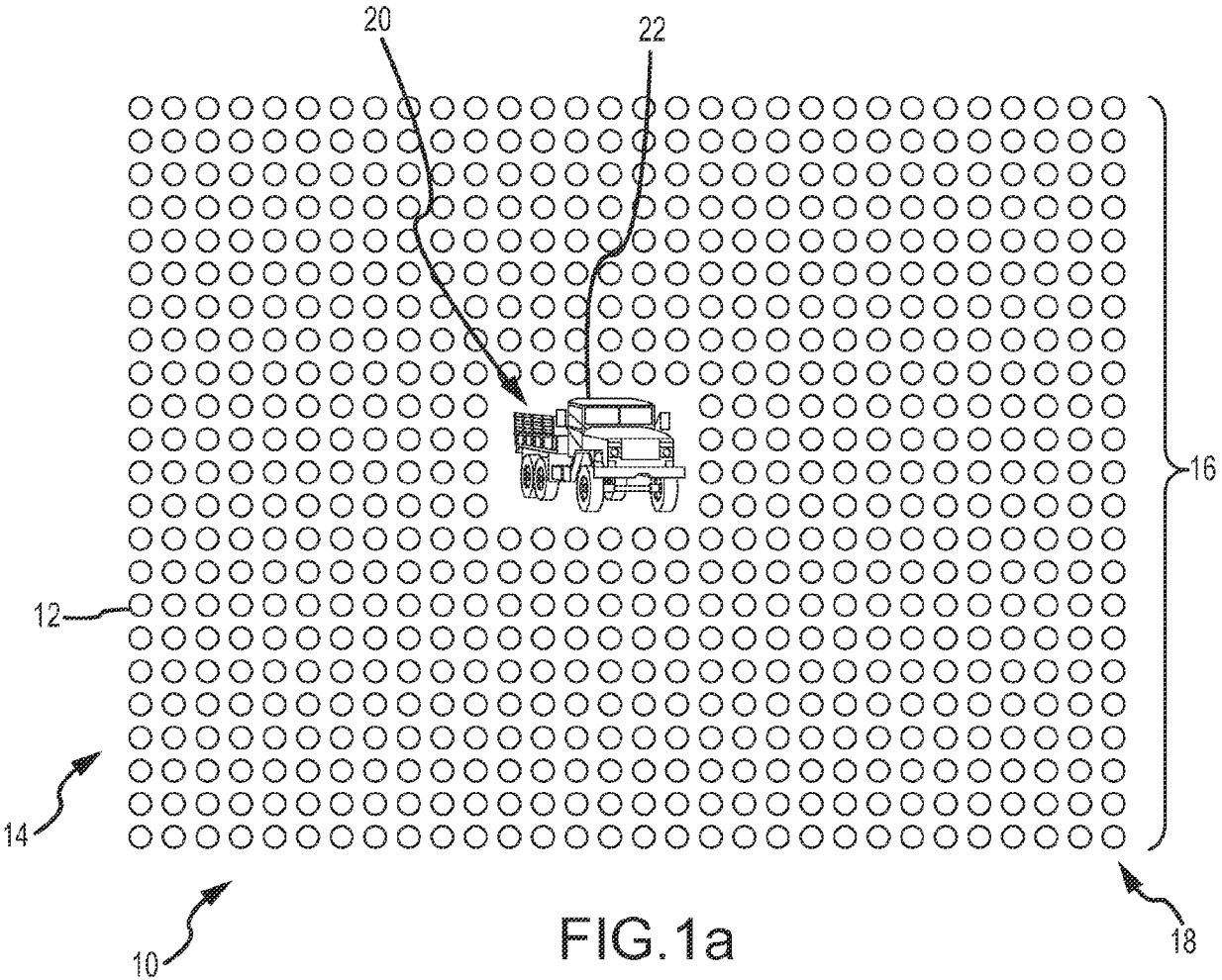
FIGS. 1*a* and 1*b* are planar and perspective views of an embodiment of a shock wave barrier comprising a periodic structure of metal rods in air surrounding a protected area.
Figure 1B:
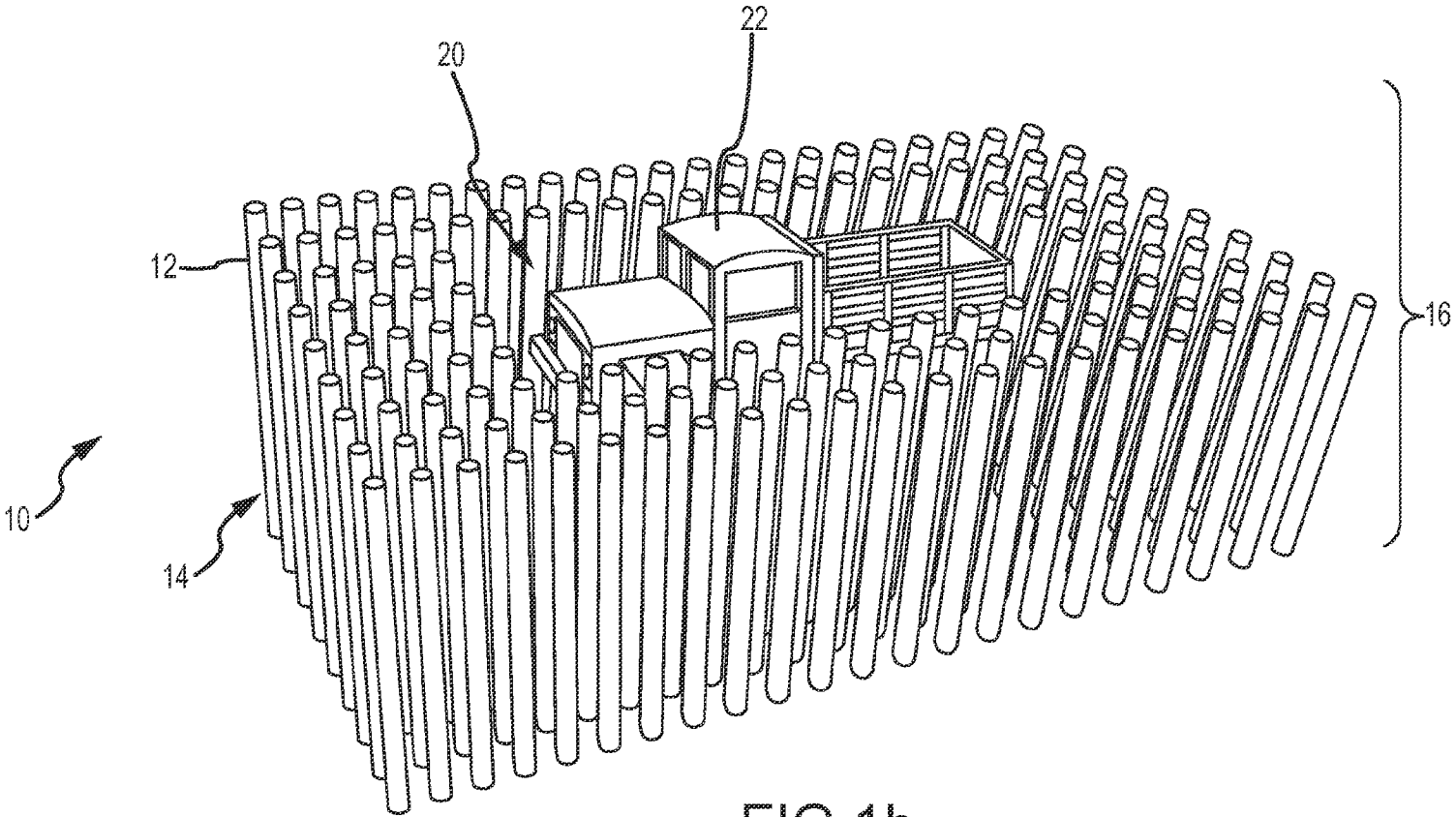
Figure 2:
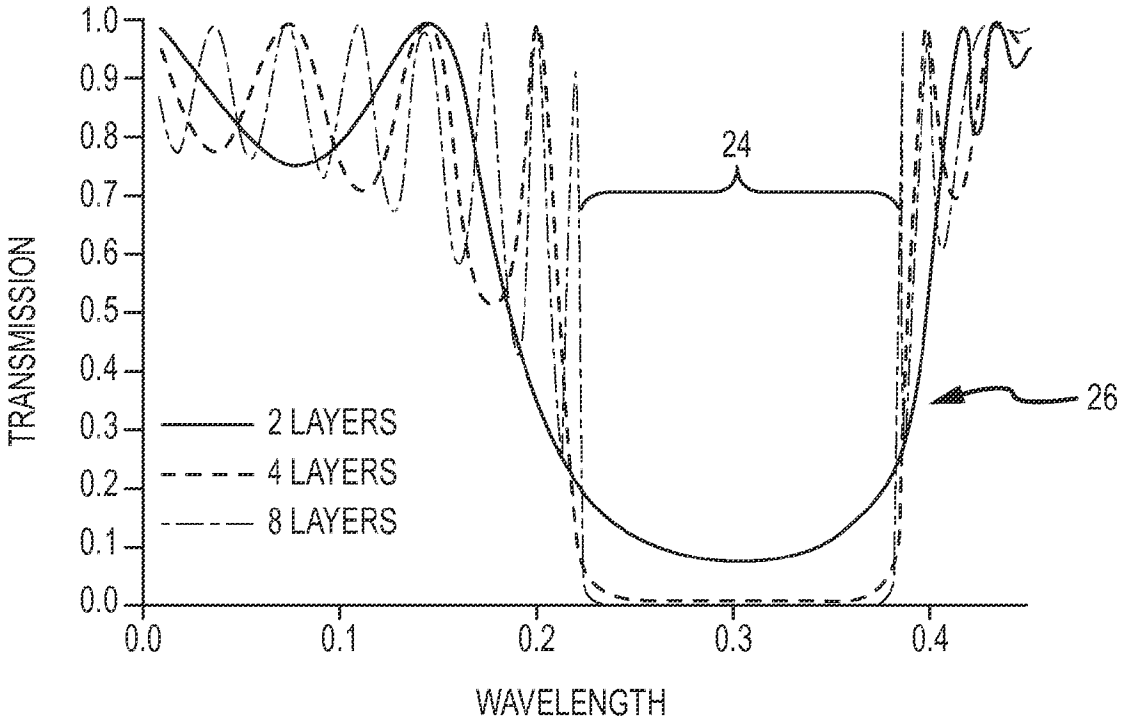
FIG. 2 is a plot of the barrier's transmission profile exhibiting a band gap.
Figure 3B:
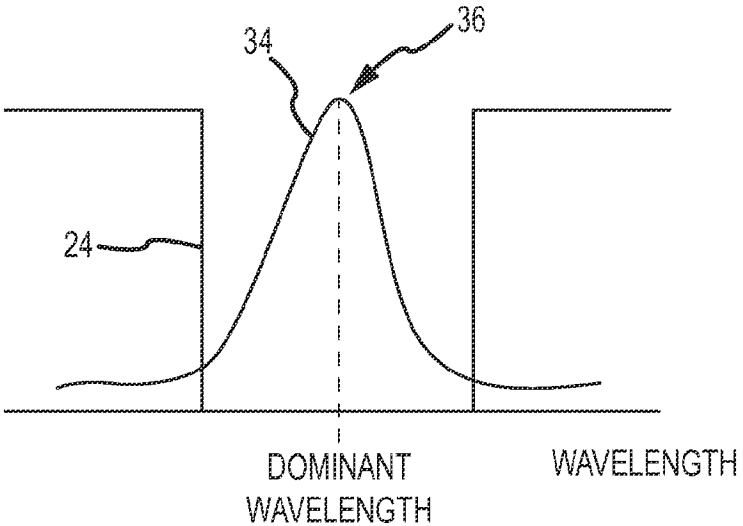
FIGS. 3*a* and 3*b* are plots of a shock wave and its response at the barrier coincident with the band gap.
Figure 3A:
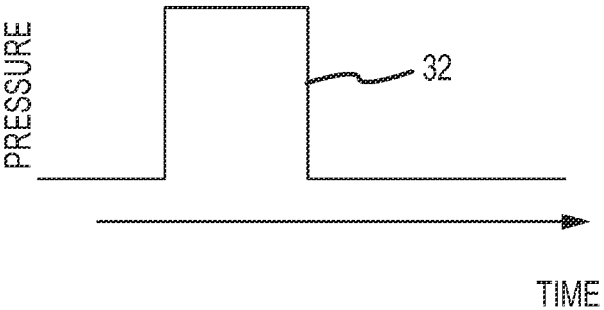
Figure 4A:
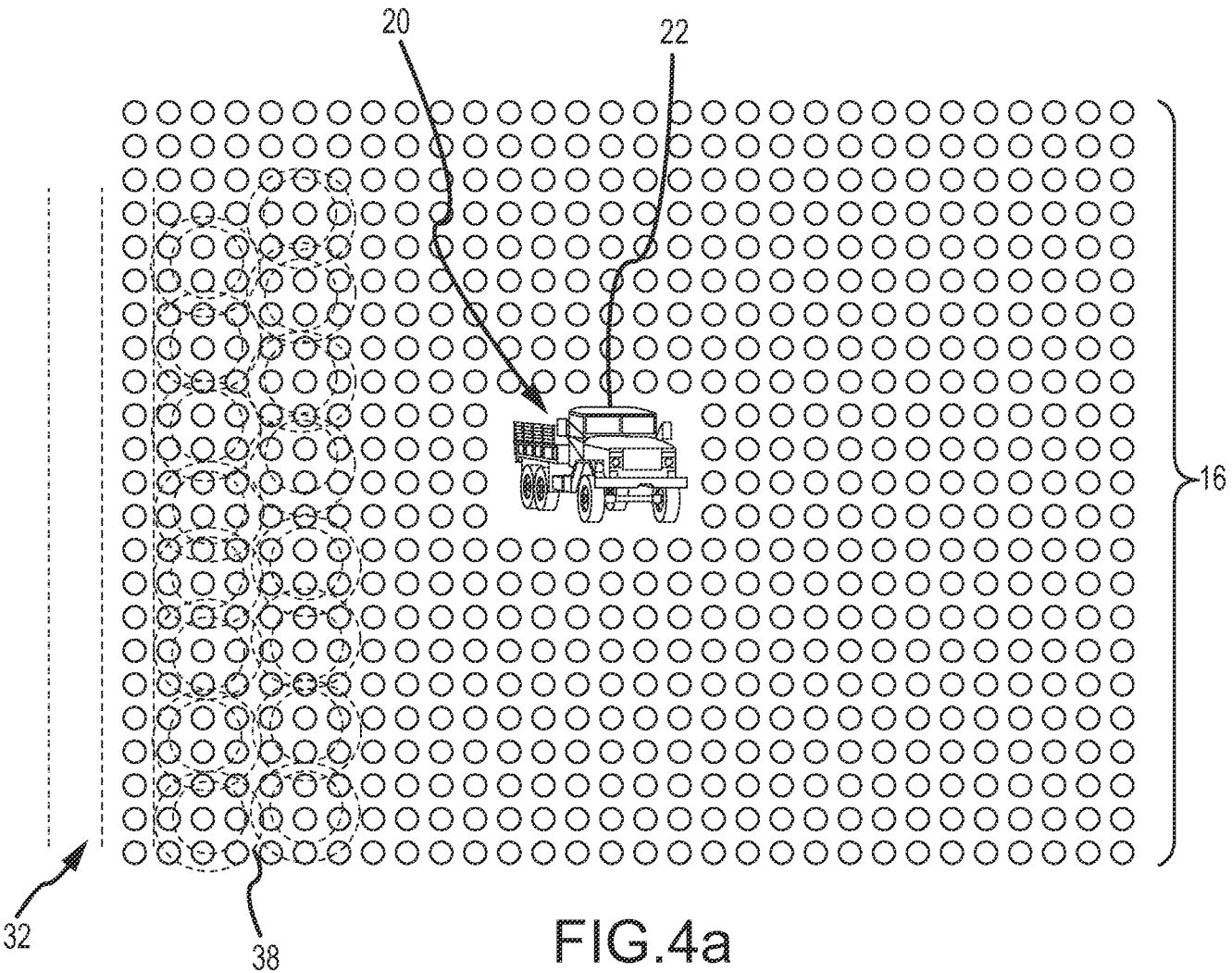
FIGS. 4*a* and 4*b* are planar and perspective views of the shock wave barrier illustrating the constructive/destructive interference that occurs in the first few layers of the periodic structure to form the band gap and reflect the energy of the shock wave.
Figure 4B:
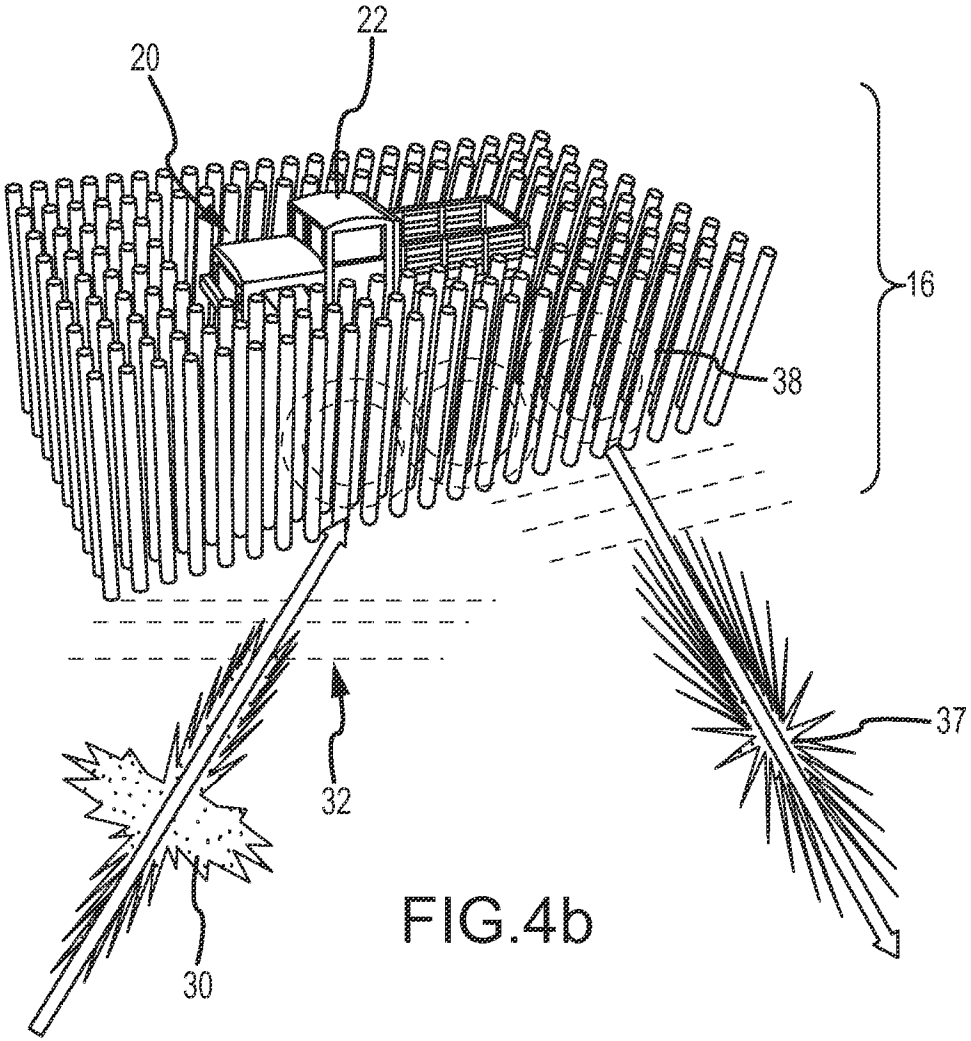

Referring now to FIGS. 1*a*-1*b* and 2, in an embodiment a shock wave barrier 10 comprises a first media of linear elements (e.g. rods) 12 and a second media of air 14 arranged in a periodic structure 16 of multiple layers 18 around a protected area 20 and asset 22. The first and second media have different acoustic indices of refraction that provide a local contrast modulation of the acoustic index orthogonal to the linear elements and the periodic structure. The symmetry of the periodic structure and local contrast modulation define a band gap 24 in a transmission spectrum 26 of the periodic structure. Incident energy that falls within the band gap 24 is reflected from the periodic structure. The periodic structure is suitably configured such that the band gap 24 spans the dominant wavelengths incident on the structure for a variety of potential threats (e.g. varying blast pressures at varying distances to the protected area). In some embodiments, the rods 12 may be retractable to allow ingress or egress to the protected asset or of the protected asset.

Periodic structure 16 is configured to produce constructive/destructive interference of an incident shock wave to define band gap 24. The symmetry, local contrast modulation, number of layers and spacing of the periodic structure form band gap 24 and determine its center wavelength, width and definition.

Periodic structure 16 exhibits a symmetry that will form a band gap. There are many crystal and quasi-crystal lattices that are known to form band gaps in crystalline periodic structures. To form periodic structure 16 the first media (rods) 12 are arranged in a pattern corresponding to the vertices of the crystal or quasi-crystal lattice within the second media (air) 14. In this particular embodiment, the periodic structure is based on a square crystal lattice. Other patterns based on, for example, a triangular or honeycomb crystal lattice may be used.

A crystal lattice exhibits translational symmetry if the structure can be translated by a certain distance and remains identical. The quasi-crystal lattice exhibits rotational symmetry if the structure may be rotated through a certain angle (less than 360 degrees) and remains identical. Rotational symmetry may also provide the added benefit of providing no linear path through the structure thereby enhancing the structure's capability as a fragment barrier. Certain crystal lattices exhibit both translational and rotational symmetry. Translation or rotational symmetry is a necessary but not sufficient condition to produce a band gap. To date, no general solution has been identified to specify all types of crystals and quasi-crystals that will form band gaps.

Periodic structure 16 exhibit a minimum local contrast modulation of the acoustic index of approximately 2:1 to form a complete band gap. This modulation produces a velocity contrast in the shock wave incident upon the first layers of the periodic structure where the wave constructively and destructively interferes. Contrast modulations of 10:1 or greater may be achieved (e.g. steel rods in air or void spaces (air) in concrete) that produce a 50% band gap or greater. The width of the band gap is typically referenced to its center wavelength.

The 'acoustic index' of refraction is defined as the ratio of the speed of sound in a control medium to the speed of sound in the material of interest. We have selected diamond as the control medium although any medium can be used. When computing the contrast or local modulation of the acoustic index the control medium cancels out leaving only the properties of the first and second media. Table 1 lists a number of different media, the speed of sound in the material and acoustic indices. The Table is not an exhaustive list of usable media, merely representative. As shown a combination of metal and air produces modulations in excessive of 10:1.

TABLE 1

| Material | m/sec | Acoustic Index |
|---|---|---|
| Diamond | 12000 | 1.00 |
| Air (STP) | 343 | 35 |
| Aluminum | 4877 | 2.46 |
| Brass | 3475 | 3.45 |
| Copper | 3901 | 3.08 |
| Iron | 5130 | 3.08 |
| Lead | 1158 | 10.36 |
| Steel | 6100 | 1.97 |
| Water | 1433 | 8.37 |
| Concrete | 3200-3600 | 3.33-3.75 |
| Brick | 4176 | 2.87 |

Periodic structure 16 includes multiple layers 18 to adequately establish and define band gap 24. As shown in FIG. 2, the definition of band gap 24 improves with additional layers. Typically, a periodic structure comprising 6-10 layers 18 provide a well-defined band gap 24 with approximately zero transmission across the band gap.

The wavelength at the center of the band gap is approximately equal to or at least on the order of the spacing 'd' in periodic structure 16. Secondary factors such as element diameter, element shape and small positional placement of the elements that are slightly symmetry braking will contribute to the exact spacing 'd' required for a specific center wavelength.

In an embodiment, periodic structure 18 may be actively controlled to open or close the band gap, or shift the edges of the band gap. The periodic structure may be actively controlled by modulating the contrast of the acoustic indices, changing the geometric arrangement or altering the symmetry.

Referring now to FIGS. 3*a*-3*b* and 4*a*-4*b*, an explosive detonation 30 produces a shock wave 32. Shock wave 32 travels as a plane wave at supersonic speed in air towards periodic structure 16 and protected area 20 and asset 22. The shock wave is characterized by an abrupt, nearly discontinuous change in the air pressure.

Simplifying, the blast pressure produced by the explosive detonation forms the initial shock wave. The response 34 of the shock wave as it arrives at the barrier may be characterized by a dominant wavelength 36. Most of the energy in the shock wave is centered about the dominant wavelength. This wavelength is to a large extent determined by the amount and type of explosive. As the shock wave propagates through air towards the protected area and decays its dominant wavelength shifts downwards. Consequently, the dominant wavelength incident on the periodic structure is determined by the initial blast pressure and the range. Depending upon the application (protected area and asset) and the potential threats (initial blast pressures and ranges), the periodic structure is configured to present a band gap that spans the dominant wavelengths of the incident shock wave for a variety of potential threats. The band gap is also positioned to reflect those wavelengths that most efficiently and destructively couple to the asset.

When shock wave 32 reaches periodic structure 16 energy within band gap 24 will constructively and destructively interfere and be substantially reflected away from the structure as reflected energy 37 while energy outside the band gap will be transmitted through the structure. The incident shock wave interacts with the rods in the periodic structure to produce secondary waves 38. These secondary waves intersect and produce destructive interference and cancellation of a wide band of wavelengths to form the band gap. The energy outside the band gap is naturally attenuated or does not couple destructively to the asset.

Figure 5:
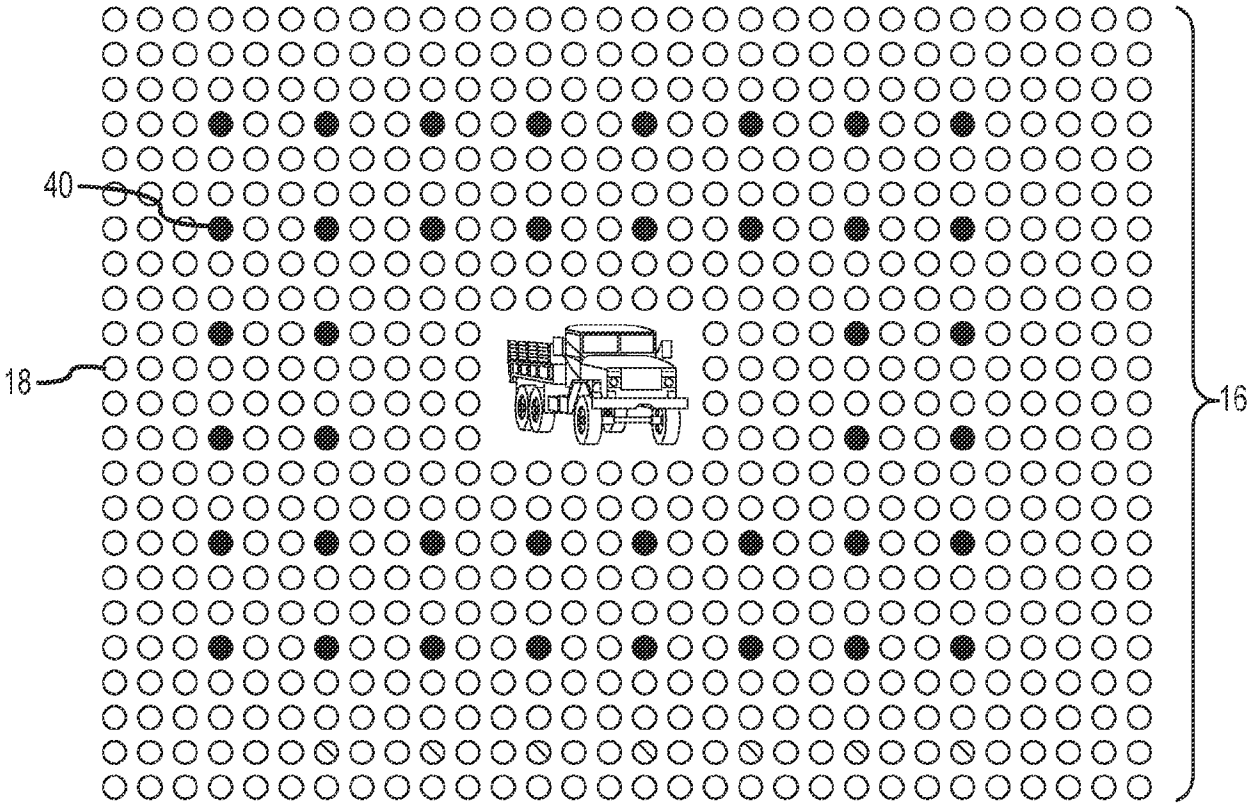
FIG. 5 is a planar view of an embodiment of a shock wave barrier comprising defect cavities formed in the periodic structure that form a resonance in the band gap to collect energy from the shock wave.
Figure 6:
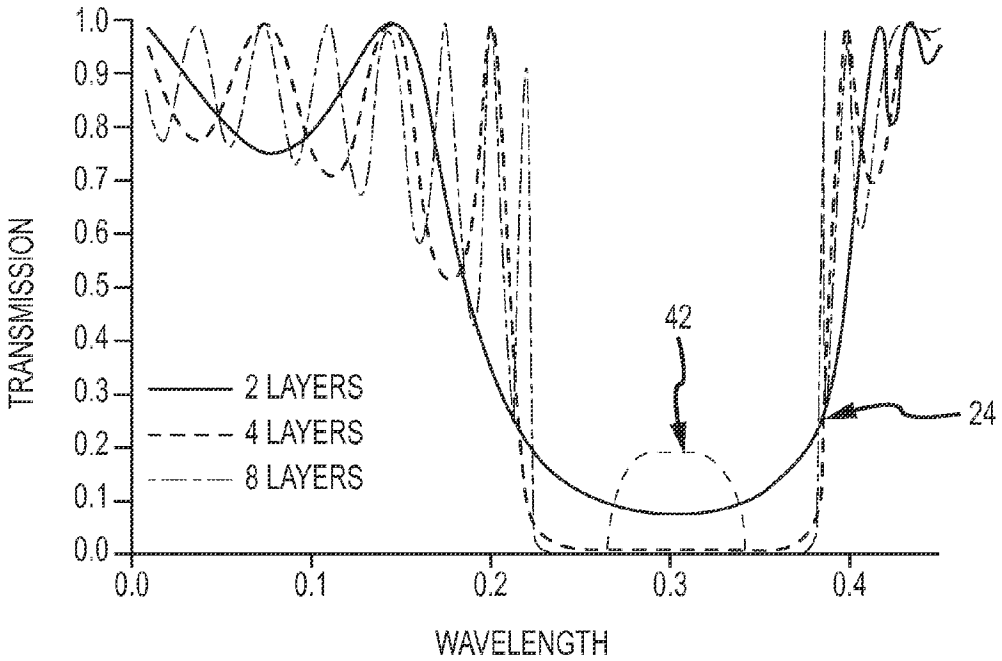
FIG. 6 is a plot of the barrier's transmission profile exhibiting a defect resonance within the band gap.

In certain situations it may not be desirable to reflect all or even a substantial portion of the shock wave. The reflection may cause collatoral damage of other nearby assets. As shown in FIG. 5, defect cavities 40 may be formed in the first few layers of periodic structure 16. The defect cavity may be any significant disturbance or "defect" in the periodic structure e.g. the absence of one or more rods 18 or different geometry of the one or more rods 18. Defect cavities 40 create a transmission resonance 42 or "window" in band gap 24 as shown in FIG. 5. The defect cavity may be detuned to control the width of the transmission resonance. The defect cavity may be detuned by altering the size of the defect, the acoustic index of refraction or the lattice constant of the periodic structure. A portion of the incident energy passes through the window and is concentrated in the defect cavities where it is dissipated by other means.

Figure 7:
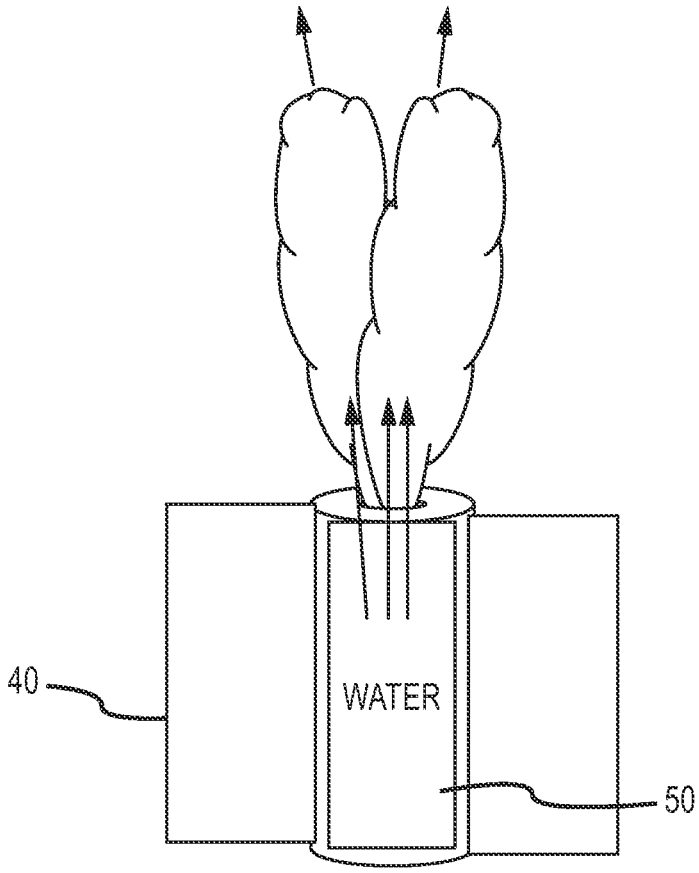
FIG. 7 is a diagram of a water filled defect cavity configured to dissipate the collected energy by expelling the water from the cavity.

As shown in FIG. 7, an embodiment to dissipate the energy concentrated in the defect cavities is to fill the cavities 40 with another media 50 such as water or sand. The energy is dissipating by ejecting media 50 from the defect cavity.

Figure 8:
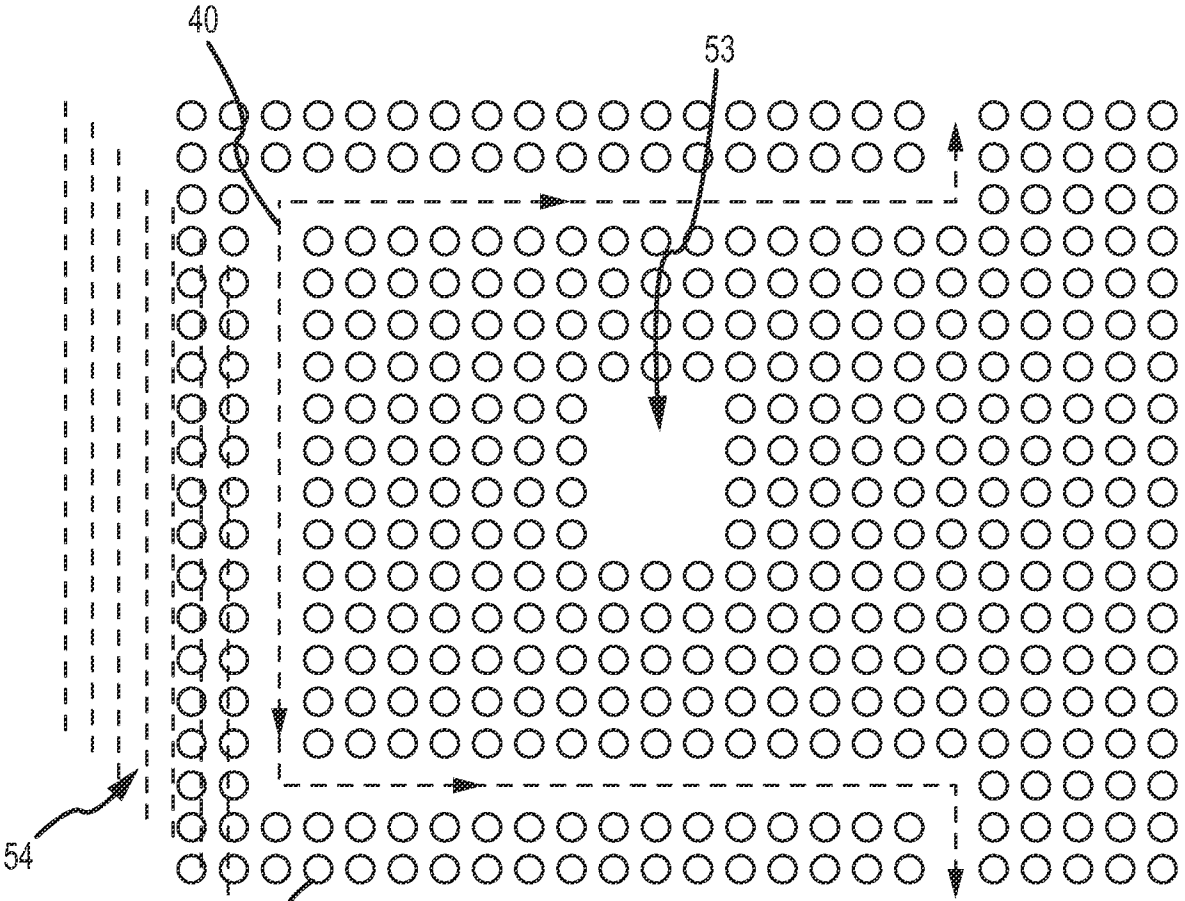
FIG. 8 is a plan view of a periodic structure including multiple defect cavities that form a waveguide to collect and reroute the transmitted energy away from the protected area.

As shown in FIG. 8, another embodiment to dissipate the energy is to configure the defect cavities 40 to form a waveguide 52 to reroute the energy around and away from a protected area 53. The energy from an incident plane wave 54 is collected by the defect cavities 40 and routed through waveguide 52 around protected area 53.

Figures 9A, 9B:
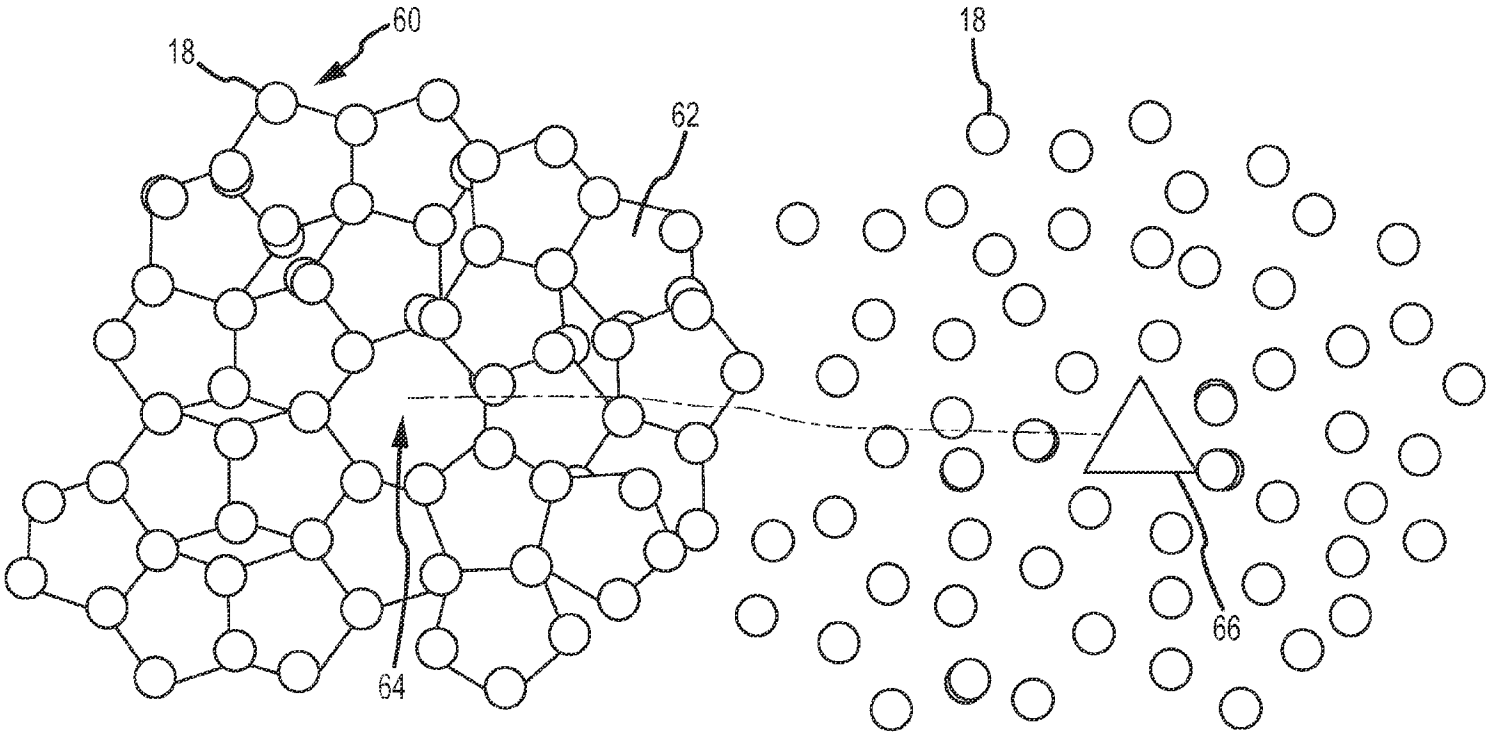
FIGS. 9*a* and 9*b* are diagrams of a periodic structure that exhibits rotational symmetry.

As shown in FIG. 9, rods 18 may be positioned at the vertices 60 of a quasi-crystal lattice 62 around a protected area 64 and asset 66. The pattern of rods 18 exhibits a rotational symmetry that forms a band gap. A benefit of this pattern is that it provides no clear linear path from the outside through the periodic structure to the protected area. This increases the periodic structure's viability as a fragment barrier in addition to being a shock wave barrier.

The periodic structure may comprise a three-dimensional structure that provides local contrast modulation in two dimensions. This structure comprises three-dimensional objects (spheres, cubes, rods, etc.) arranged with certain symmetry in a contrasting media that form a band gap.

Figure 10:
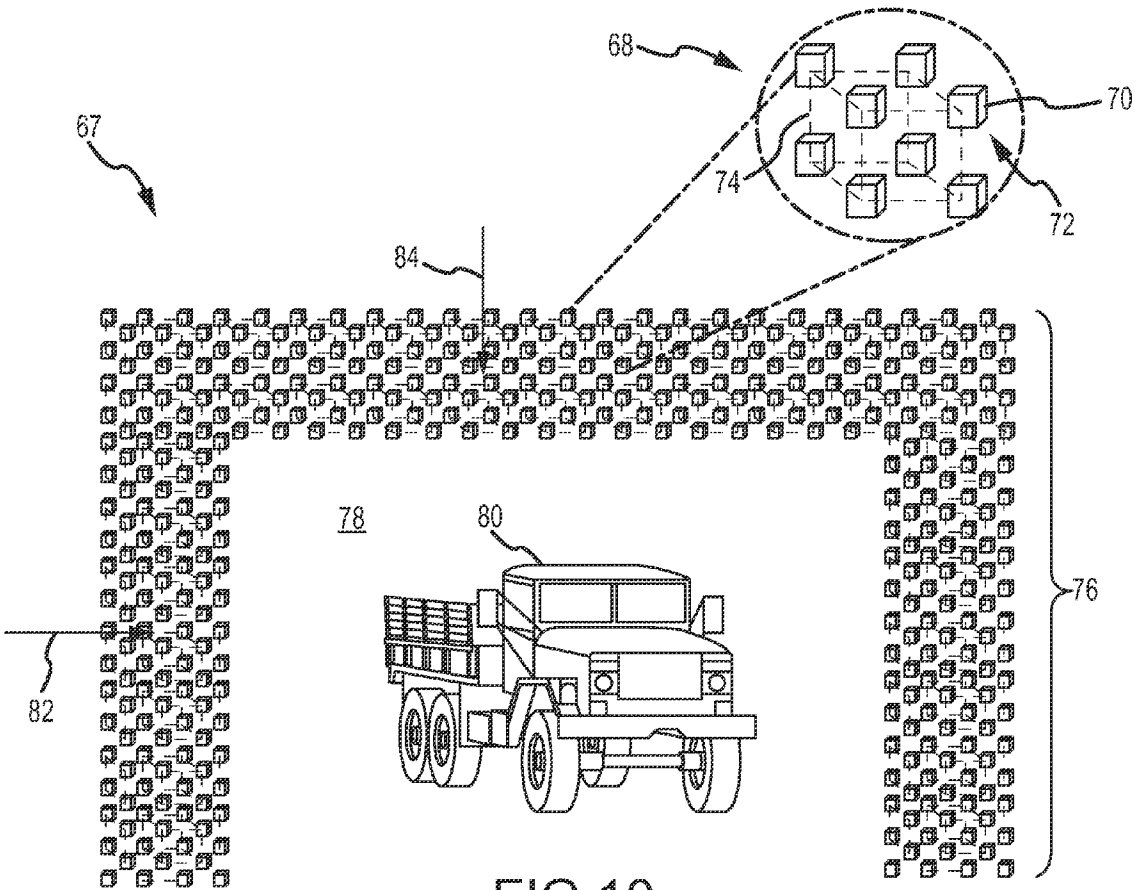
FIG. 10 is a diagram of an embodiment of a three-dimensional periodic structure comprising void spheres arranged in a concrete hemisphere.

Referring now to FIG. 10, in an embodiment of a three-dimensional shock wave barrier 67 a unit cell 68 of the periodic structure comprises cubes 70 arranged at the vertices 72 of a cubic lattice 74. Unit cells 68 are repeated in a three-dimensional periodic structure 76 both around and above a protected area 78 and asset 80. The structure provides local contrast modulation in a first dimension 82 orthogonal to its walls and a second dimension 84 orthogonal to the ceiling. As such, shock wave energy from either a terrestrial or airborne explosive detonation may be reflected. In an alternate embodiment, the unit cells 68 may be repeated in a hemispheric configuration around and above protected area 78. In one example, cubes 70 are void spaces of air embedded in a concrete media. Alternately, cubes 70 may be metal objects suspended in a lattice in air.

Figure 11:
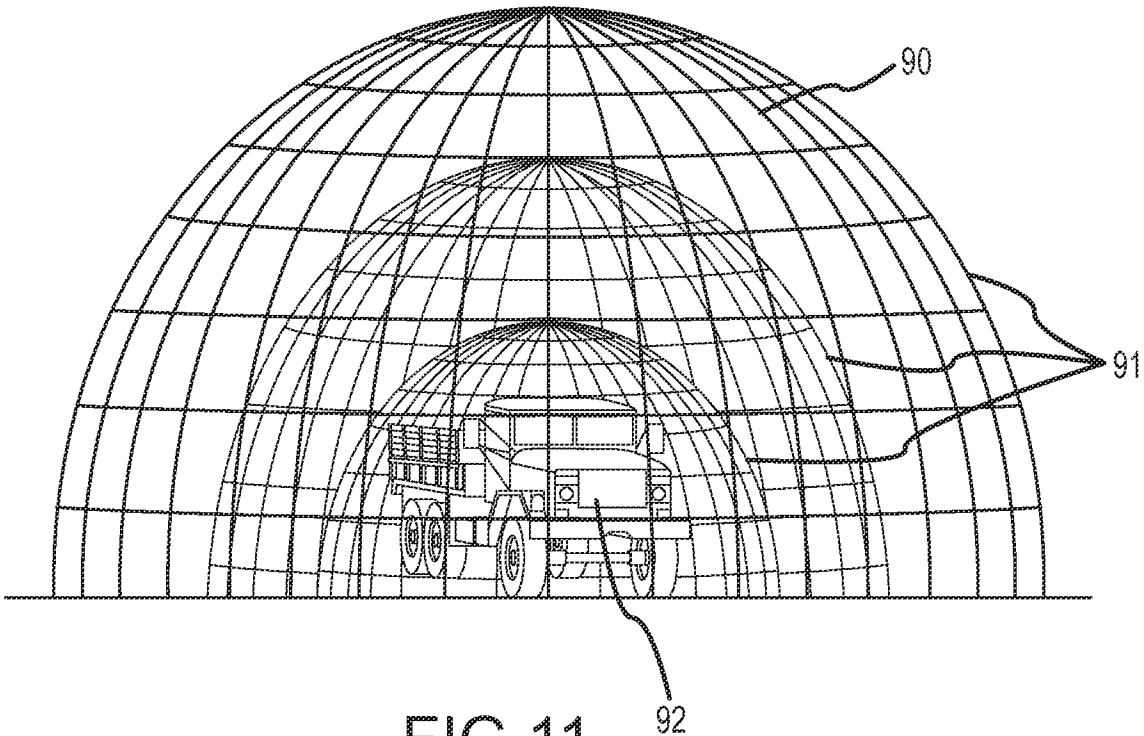
FIG. 11 is a diagram of an embodiment of a three-dimensional periodic structure comprising concentric hemispheric mesh structures arranged in air.

Referring now to FIG. 11, in an embodiment of a three-dimensional shock wave barrier 89 comprises unit cells 90 constructed from welded circular elements of a suitable material such as steel. The three-dimensional periodic structure is formed of concentric hemispheres 91 of unit cells 90 with the appropriate spacing. The band gap is obtained by arranging smaller concentric hemisphere structures with the appropriate spacing between hemisphere radii. A protected asset 92 sits at the center of the structure that contains at least 6 concentric hemispheres. A door structure may be provided thru the hemispheres for ingress and egress.

As described above, the shock wave barrier may be configured to protect an area and an asset from shock waves travelling in air. The barrier may be configured to protect an area and an assets from shock waved travelling in liquid (e.g. the ocean), in solids (e.g. tank armor) or through the ground towards an underground area. The dominant wavelengths of the shock wave will change, hence the spacing of the periodic structure will change to position a band gap coincident with the dominant wavelength but the principle remains the same.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A shock wave barrier for an asset in a protected area, comprising:

first and second media arranged in a multidimensional periodic structure having a symmetry, said structure positioned between the protected area and one or more potential explosive detonation threats, said first and second media having different acoustic indices of refraction that provide a local contrast modulation of the acoustic index that in conjunction with the symmetry of the structure defines a band gap in a transmission spectrum of the periodic structure, said first and second media spaced in the periodic structure to position the band gap coincident with the dominant wavelength of the shock wave for one or more potential explosive detonation threats.

2. The shock wave barrier of claim 1, wherein the periodic structure reflects show shock wave energy at wavelengths within the band gap.

3. The shock wave barrier of claim 1, wherein the periodic structure exhibits translational or rotational symmetry.

4. The shock wave barrier of claim 1, wherein the local contrast modulation of the acoustic index is at least 2:1.

5. The shock wave barrier of claim 1, wherein the periodic structure comprises at least six layers within which the shock wave constructively and destructively interferes to form the band gap.

6. The shock wave barrier of claim 1, wherein the first media comprises air.

7. The shock wave barrier of claim 6, wherein the local contrast modulation of the acoustic index is at least 10:1 and the width of the band gap is at least 50% of the center wavelength of the band gap.

8. The shock wave barrier of claim 1, wherein said first media comprises linear elements that provide local contrast modulation in two dimensions, said linear elements arranged in said second media in a three-dimensional periodic structure that define the local contrast modulation and band gap approximately in two dimensions.

9. The shock wave barrier of claim 8, wherein the linear elements may be retracted to permit ingress and egress from the protected area.

10. The shock wave barrier of claim 1, wherein said first media comprises three-dimensional geometric objects that provide local contrast modulation in three dimensions, said three-dimensional objects arranged in said second media in a three-dimensional periodic structure that defines the local contrast modulation and band gap in three dimensions.

11. The shock wave barrier of claim 1, further comprising:

one or more defect cavities in the periodic structure that create a transmission resonance with the band gap that allows energy from the shock wave to pass into the structure where it is concentrated within the one or more defect cavities.

12. The shock wave barrier of claim 11, wherein the one or more defect cavities are filled with a third media that is ejected from the cavity to dissipate the energy.

13. The shock wave barrier of claim 11, wherein a plurality of said defect cavities forms a waveguide that routes the energy away from the protected area.

14. A shock wave barrier for an asset in a protected area, comprising:

linear elements arranged in air around a protected area in a three-dimensional periodic structure that exhibits translational or rotational symmetry, said linear elements having an acoustic index of refraction of at most one-tenth that of air to provide a local contrast modulation of the acoustic index in two-dimensions of at least 10:1 that in conjunction with the symmetry of the structure defines a band gap in a transmission spectrum of the periodic structure, said linear elements spaced in the periodic structure to position the band gap coincident with the dominant wavelength of the shock wave for one or more potential explosive detonation threats, said band gap having a width of at least 50% of its center wavelength.

15. The shock wave barrier of claim 14, wherein the periodic structure reflects shock wave energy at wavelengths within the band gap.

16. The shock wave barrier of claim 14, further comprising:

one or more defect cavities in the periodic structure that create a transmission resonance within the band gap that allows energy from the shock wave to pass into the structure where it is concentrated within the one or more defect cavities; and means for dissipating the energy in the one or more defect cavities.

17. The shock wave barrier of claim 14, wherein the linear elements may be retracted to permit ingress and egress from the protected area.

18. A shock wave barrier for an asset in a protected area, comprising:

first and second media arranged in a multidimensional periodic structure having a symmetry, said structure positioned between the protected area and one or more potential explosive detonation threats, said first and second media having different acoustic indices of refraction that provide a local contrast modulation of the acoustic index that in conjunction with the symmetry of the structure defines a band gap in a transmission spectrum of the periodic structure, said first and second media spaced in the periodic structure to position the band gap coincident with the dominant wavelength of the shock wave for one or more potential explosive detonation threats;

one or more defect cavities in the periodic structure that create a transmission resonance with the band gap that allows energy from the shock wave to pass into the structure where the energy is concentrated within the one or more defect cavities; and means for dissipating the energy in the one or more defect cavities.

19. The shock wave barrier of claim 18, wherein the means for dissipating the energy comprises a third media in the one or more defect cavities that is ejected from the cavity to dissipate the energy.

20. The shock wave barrier of claim 18, wherein the means for dissipating the energy comprises a waveguide formed by a plurality of said defect cavities that routes the energy away from the protected area.

* * * * *